US006381437B1

(12) United States Patent
Ozawa et al.

(10) Patent No.: US 6,381,437 B1
(45) Date of Patent: Apr. 30, 2002

(54) IMAGE FORMATION METHOD AND APPARATUS USING ELECTROPHOTOGRAPHY

(75) Inventors: Yoshio Ozawa, Tokyo; Hisashi Mukataka, Watarai-gun Mie; Yojiro Sato, Watarai-gun Mie; Yuji Kamiyama, Watarai-gun Mie; Motoki Moriguchi, Watarai-gun Mie, all of (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/677,111

(22) Filed: Sep. 29, 2000

Related U.S. Application Data

(63) Continuation of application No. 09/124,389, filed on Jul. 29, 1998, now abandoned.

(30) Foreign Application Priority Data

Jul. 31, 1997 (JP) ..... 9-219989

(51) Int. Cl.[7] ..... G03G 21/00

(52) U.S. Cl. ..... 399/350; 399/71; 399/116; 399/159; 430/110.1; 430/125

(58) Field of Search ..... 430/110.1, 125; 399/71, 116, 159, 350

(56) References Cited

U.S. PATENT DOCUMENTS 5,252,398 A * 10/1993 Ohtani et al. ..... 428/403
5,538,826 A * 7/1996 Ainoya et al. ..... 430/67
5,604,574 A * 2/1997 Matsura et al. ..... 399/350
5,679,488 A * 10/1997 Itami et al. ..... 430/66
5,721,085 A * 2/1998 Oshiba et al. ..... 430/125
5,824,444 A * 10/1998 Kinoshita et al. ..... 430/58.4
5,824,445 A * 10/1998 Ochiai et al. ..... 430/106.6
5,914,210 A * 6/1999 Demizu et al. ..... 430/110

* cited by examiner

*Primary Examiner*—Mark Chapman
(74) *Attorney, Agent, or Firm*—Schulte Roth & Zabel; Donna Angotti; Joel Lutzker

(57) ABSTRACT

Disclosed is an image formation method using electrophotography, comprising the steps of supplying a developer by a developing device (17) onto a photosensitive drum (11) in rotation to form a toner image thereon, transferring the formed toner image onto a transfer paper to form an image on the transfer paper, and removing untransferred developer by use of a cleaning blade (21), wherein an OPC photosensitive drum (11) is used for the photosensitive drum and includes a photosensitive layer (27) being formed on an electrically conductive base (25) and having an initial thickness which is a value within a range of 20 to 50 $\mu$m, and wherein the amount X of reduction in the thickness of the photosensitive layer (27) in the OPC photosensitive drum (11) satisfies the following expression (1)

$$0.5\ \mu m < 30X/R < 1.5\ \mu m \quad (1)$$

X: by way of example, the amount ($\mu$m) of reduction in the thickness of photosensitive layer (27) when 10,000 sheets have been printed at printing speed of 6 sheets/min using A4 size transfer paper longitudinal feeding apparatus; and R: diameter (mm) of OPC photosensitive drum (11).

20 Claims, 4 Drawing Sheets

IMAGE FORMATION METHOD AND APPARATUS USING ELECTROPHOTOGRAPHY

This application is a continuation (and claims the benefit of priority under 35 USC 120) of U.S. application Ser. No. 09/124,389, filed Jul. 29, 1998 now abandoned. The disclosure of the prior application is considered part of (and is incorporated by reference in) the disclosure of this application.

TECHNICAL FIELD

The present invention relates to an image formation method using electrophotography. More particularly, the present invention relates to an image formation method using electrophotography, capable of ensuring excellent printing properties and cleanability over a long period of time in a printing apparatus such as a printer.

BACKGROUND ART

An image formation method using electrophotography is in wide use in the printing apparatus such as a printer and a facsimile, and consists basically of the following four steps (1) to (4):

(1) a step of uniformly charging a photosensitive body in darkness;
(2) a step of exposing the charged photosensitive body to light to form a desired electrostatic latent image thereon;
(3) a step of forming a toner image by a developer (toner) corresponding to the electrostatic latent image; and
(4) a step of transferring the toner image on the photosensitive body to transfer paper and fixing it thereat to form an image.

Therefore, in order to carry out such an image formation method using electrophotography, as shown in FIG. 1, members such as a photosensitive drum 11, a charging device 13, an image signal exposing device 15, a developing device 17, a transfer roll 19, a cleaning blade 21 and a full area exposing device 23 are provided in the interior of a printing apparatus such as a printer.

Thus, to form an image in the printing apparatus, the charging device 13 is used to uniformly charge the rotating photosensitive drum 11 in darkness, after which the image signal exposing device 15 is used to expose the charged photosensitive drum 13 to light to thereby form a desired electrostatic latent image. Then, in such a manner as to correspond to the thus formed electrostatic latent image, the developer is supplied from the developing device 17 to form a toner image, which toner image in turn is transferred to the transfer paper and fixed thereat to form an image while removing untransferred developer by use of the cleaning blade 21.

Here, known as an example of the conventional photosensitive drum is a photosensitive drum using amorphous silicon as a photosensitive layer. Use of a transfer paper longitudinal feeding apparatus having such a photosensitive drum ensures formation of images with a stabilized printing density even in the case where by way of example 10,000 sheets or more have been printed at a printing speed of 6 sheets (A4 size transfer paper)/min.

However, the photosensitive drum using amorphous silicon as the photosensitive layer suffered from a drawback that it was generally difficult to manufacture it in a stabilized manner, with its high manufacturing costs.

An organic photoconductor (hereinafter "OPC") photosensitive drum has thus been proposed which consists of an electrically conductive base and an OPC photosensitive layer formed on top of the surface thereof.

Then, the OPC photosensitive drum is characterized by the provision of a photosensitive layer made of a photosensitive material (OPC material) dispersed or carried in a binder resin, the photosensitive layer typically having the initial thickness within a range of 15 to 20 mm. Such an OPC photosensitive drum as shown in FIGS. 2 and 3 includes a single or a plurality of photosensitive layer(s) 27 disposed on top of the electrically conductive base 25. In case the photosensitive layer 27 comprises a plurality of layers, it consists typically of a charge generation layer 31 formed on the electrically conductive base 25 and of a charge transfer layer 33 further formed thereon. Then, such an OPC photosensitive drum has an advantage that it is generally easy to manufacture it, with the result that its manufacturing costs are low.

However, the conventional OPC photosensitive drum posed a problem that the photosensitive layer was easy to wear, making it substantially difficult to form images with stabilized printing density for a long period of time, for example, over 100,000 sheets at a printing speed of 6 sheets/min using the A4 size transfer paper longitudinal feeding apparatus.

Another problem was found that in the case of using the OPC photosensitive drum the cleanability of the OPC photosensitive drum was liable to lower in a short period of time. It was therefore disadvantageously difficult to remove untransferred developer in the form of toner filming phenomena by use of the cleaning blade.

For this reason, when the OPC photosensitive drum was used as the photosensitive drum, the replacement of the OPC photosensitive drum in a short period of time was hitherto inevitable. Accordingly, such a frequent replacement of the OPC photosensitive drum led to a rise in the print costs and maintenance costs, and further went against a trend toward savings of resources with the aim of global environmental protection.

In recent years, a so-called process cartridge is also employed which has been formed by integrating the photosensitive drum, the charging device, the developing device, the cleaning blade, etc., into a single unit. In this case, replacement of the OPC photosensitive drum will need the replacement and discard of other constituent elements as well, resulting further increased economical disadvantages.

Thus, as a result of wholehearted consideration, the inventors of the present invention have found out that by forming on the electrically conductive base an OPC photosensitive layer having a relatively large thickness and by limiting to a value within a certain range the amount X of reduction in the thickness of the photosensitive layer in a relatively short period of time (by way of example, a period of time corresponding to when 10,000 sheets have been printed at a printing speed of 6 sheets/ min using the A4 size transfer paper longitudinal feeding apparatus, which may hereinafter be referred to as 10,000 sheets corresponding time) in the OPC photosensitive drum, it is possible to maintain the charging retention function in the photosensitive drum over a longer period of time (by way of example, a period of time corresponding to when 100,000 sheets have been printed at a printing speed of 6 sheets/ min using the A4 size transfer paper longitudinal feeding apparatus, which may hereinafter be referred to as 100,000 sheets corresponding time), with the result that the surface potential necessary for the image formation can be secured over a longer period of time.

DISCLOSURE OF THE INVENTION

It is therefore the object of the present invention to provide an image formation method using electrophotography, capable of ensuring excellent printing properties and cleanability over a long period of time even in case the OPC photosensitive drums having the photosensitive layers with variously different diameters have been used.

According to an aspect of the present invention, there is provided an image formation method using electrophotography, comprising the steps of supplying a developer by a developing device onto a photosensitive drum in rotation to form a toner image thereon, transferring the formed toner image onto a transfer paper to form an image on the transfer paper, and removing untransferred developer by use of a cleaning blade, wherein an OPC photosensitive drum is used for the photosensitive drum and includes a photosensitive layer being formed on an electrically conductive base and having an initial thickness which is a value within a range of 20 to 50 $\mu$m and wherein the amount X of reduction in the thickness of the photosensitive layer in the OPC photosensitive drum satisfies the following expression (1)

$$0.5\ \mu\text{m} < 30X/R < 1.5\ \mu\text{m} \quad (1)$$

X: by way of example, the amount ($\mu$m) of reduction in the thickness of photosensitive layer when 10,000 sheets have been printed at printing speed of 6 sheets/min using A4 size transfer paper longitudinal feeding apparatus; and R: diameter (mm) of OPC photosensitive drum.

In this manner, by forming on the electrically conductive base an OPC photosensitive layer having a relatively large thickness and by limiting to a value within a certain range the amount X of reduction in the thickness of the photosensitive layer in a relatively short period of time (10,000 sheets corresponding time) in the OPC photosensitive drum, it is possible to obtain excellent printing properties and cleanability even after the elapse of a long period of time (100,000 sheets corresponding time).

Since the amount of reduction in the thickness can be controlled at 10,000 sheets corresponding time, correction to within an appropriate range is easy to perform even though the value suffered from a deviation. It is to be appreciated that by changing the thickness or material of the cleaning blade or by altering the position of the cleaning blade, it is possible to adjust or control the amount of reduction in the thickness.

In the present invention, the time to measure the amount X of reduction in the thickness of the photosensitive layer is not necessarily limited to the time when 10,000 sheets of A4 size transfer paper have been printed, and the measurement could be performed at any time corresponding to the print of that transfer paper. In this respect, the same applies to the following description. Therefore, more specifically, by allowing for a balance between the measurement errors of the amount X of reduction in the thickness of the photosensitive layer and the easiness of the correction or modification of the amount X of reduction in the thickness of the photosensitive layer, it is sufficient to perform the measurement during the time when 5,000 to 15,000 sheets of A4 size transfer paper have been printed, more preferably during the time when 8,000 to 12,000 sheets have been printed, most preferably during the time when 9,000 to 11,000 sheets have been printed.

For carrying out the image formation method of the present invention, it is preferred that the amount X of reduction in the thickness is measured in a continuous or intermittent manner.

By measuring the amount X of reduction in the thickness in this manner, it is possible to more easily and precisely the value of the amount X of reduction in the thickness at 10,000 sheets corresponding time. Thus, excellent printing properties and cleanability can securely be obtained even at 100,000 sheets. corresponding time.

For carrying out the image formation method of the present invention, it is preferred that the amount X of reduction in the thickness used is a mean value of the amounts of reduction in the thickness measured at three or more points on the OPC photosensitive drum in the width direction thereof.

By measuring the amount X of reduction in the thickness in this manner, it is possible to control more easily and precisely the amount X of reduction in the thickness at 10,000 corresponding time, while allowing for the dispersion of the measurement values.

For carrying out the image formation method of the present invention, it is preferred that a rate of change expressed as (Z−Y)/10,000 is a value within a range of 0.00005 to 0.00015 $\mu$m/sheet where, by way of example, Y is the amount ($\mu$m) of reduction in the thickness of the photosensitive layer when 10,000 sheets have been printed at a printing speed of 6 sheets/min using an A4 size transfer paper longitudinal feeding apparatus, and Z is the amount ($\mu$m) of reduction in the thickness of the photosensitive layer when 20,000 sheets have. been printed at a printing speed of 6 sheets/min using the A4 size transfer paper longitudinal feeding apparatus.

By controlling the change in the amount of reduction in the thickness by the rate of change in this manner, it is possible to obtain more securely excellent printing properties and cleanability at 100,000 sheets corresponding time.

For carrying out the image formation method of present invention, it is preferred that the thickness from the apex of highest protuberance lying on the surface of the electrically conductive base to the surface of the photosensitive layer is a value equal to or more than 10 $\mu$m.

Due to the existence of unevenness on the surface of the electrically conductive base, the charging retention function is liable to be controlled at a region where the photosensitive layer has the minimum thickness. Thus, by controlling the thickness of a region where the photosensitive layer has the minimum thickness, in other words, the thickness from the apex of the highest protuberance lying on the surface of the electrically conductive base to the surface of the photosensitive layer, it is possible to more securely obtain excellent printing properties and cleanability at 100,000 sheets corresponding time.

For carrying out the image formation method of the present invention, it is preferred that the photosensitive layer consists of a charge generation layer and a charge transfer layer formed thereon, and wherein the hole mobility in the charge transfer layer is a value not less than $1\times10^{-7}$ $cm^2/V\cdot s$ in the condition that the electric field strength is about $2\times10^5$ V/cm.

By controlling the hole mobility in the charge transfer layer of the photosensitive layer in this manner, it is possible to more securely obtain excellent printing properties and cleanability even at 100,000 sheets corresponding time.

For carrying out the image formation method of the present invention, it is preferred that the photosensitive layer contains polycarbonate type resin as the binder resin.

Polycarbonate type resin possesses proper hardness and durability so that excellent printing properties and cleanability can be ensured even at 100,000 sheet corresponding time. It is also easy for the photosensitive resin containing polycarbonate type resin as the binder resin to control the hole mobility.

For carrying out the image formation method of the present invention, it is preferred that a developer used in the electrophotography is a two-component developer containing carrier and toner, and wherein the loadings of the toner are a value within a range of 1 to 25 parts by weight when the total amount of the developer is 100 parts by weight.

By making up the developer in this manner, the amount of surplus toner remaining on the OPC photosensitive drum after the transfer to the transfer paper can decrease, achieving excellent printing properties and cleanability. Furthermore, due to its satisfactory cleanability, toner can easily be removed without damaging the OPC photosensitive drum by use of the cleaning blade.

For carrying out the image formation method of the present invention, it is preferred that the surface of the carrier is coated with a high molecular weight material.

By making up the carrier in this manner, a fear that the carrier may damage the OPC photosensitive drum lessens, so that it becomes possible to easily and accurately control the amount X of reduction in the thickness at 10,000 sheets corresponding time.

For carrying out the image formation method of the present invention, it is preferred that the high molecular weight material is a polyolefin type resin.

By using the carrier coated with polyolefin type resin in this manner, a tendency for the carrier to damage the OPC photosensitive drum becomes less.

For carrying out the image formation method of the present invention, it is preferred that the high molecular weight material directly polymerizes monomer onto the surface of the carrier.

By coating the high molecular weight material onto the carrier surface while directly polymerizing the monomers in this manner, it is possible to uniformly coat the high molecular weight material on the carrier surface. Accordingly, a tendency for the carrier to damage the OPC photosensitive drum becomes less.

For carrying out the image formation method of the present invention, it is preferred that the toner in the developer contains coagulated abrasive particles.

By allowing the containment of the coagulated abrasive particles in this manner, it is possible to easily adhere the toner to the OPC photosensitive drum in the development process as well as to easily remove the toner without damaging the OPC photosensitive drum by use of the cleaning blade.

For carrying out the image formation method of the present invention, it is preferred that the toner in the developer contains 0.1 to 10 parts by weight of coagulated abrasive particles when the total amount of the toner is 100 parts by weight.

By setting the content of the coagulated abrasive particles to a value within such a range, it is possible to securely adhere the toner to the OPC photosensitive drum in the development process. Furthermore, by use of the cleaning blade, unnecessary toner can easily be removed without further damaging the OPC photosensitive drum.

For carrying out the image formation method of the present invention, it is preferred that the primary particle diameter of the coagulated abrasive particles is a value within the range of 0.01 to 0.1 $\mu$m, and that the secondary particle diameter of the coagulated abrasive particles is a value within the range of 0.2 to 1.0 $\mu$m.

By restricting the relationship between the primary particle diameter and the secondary particle diameter in the coagulated abrasive particles, proper hardness and cohesiveness (loosening properties) in the coagulated abrasive particles can be obtained. It is therefore possible to securely adhere the toner to the OPC photosensitive drum in the process of the development, as well as to easily remove unnecessary toner without damaging the OPC photosensitive drum by use of the cleaning blade.

For carrying out the image formation method of the present invention, it is preferred that the coagulated abrasive particles are silica and electrically conductive titania or either of the two.

These coagulated abrasive particles possess proper hardness and cohesiveness. It is therefore possible to more securely adhere the toner to the OPC photosensitive drum in the process of the development. It is also possible to easily remove unnecessary toner without damaging the OPC photosensitive drum by use of the cleaning blade.

For carrying out the image formation method of the present invention, it is preferred that the coagulated abrasive particles adhere to the surface of the toner.

This allows loading of a small amount of coagulated abrasive particles to bring about an excellent abrasive effect.

For carrying out the image formation method of the present invention, it is preferred that the cleaning blade is formed from urethane type rubber having a thickness within the range of 1.5 to 2.0 mm.

Urethane type rubber is superior in durability and resistance to creep, and the urethane type rubber having a thickness within such a range is able to apply an appropriate contact pressure onto the OPC photosensitive drum. It is therefore possible to obtain excellent printing properties and cleanability over a long period of time without causing excessive abrasion of the OPC photosensitive drum attributable to the cleaning blade.

For carrying out the image formation method of the present invention, it is preferred that the position of the cleaning blade is variable so as to correspond to the amount X of reduction in the thickness.

By making up the cleaning blade in this manner, the cleaning blade can be arranged at a position relatively separate from the OPC photosensitive drum when the value of the amount X of reduction in the thickness is small, whereas the cleaning blade can be arranged at a position relatively close to the OPC photosensitive drum when the value of the amount X of reduction in the thickness is large. It is therefore possible to apply at all times a certain appropriate contact pressure to the OPC photosensitive drum, as well as to obtain excellent printing properties and cleanability over a long period of time.

For carrying out the image formation method of the present invention, it is preferred that at least the photosensitive drum, the developing device and the cleaning blade are integrated into a unit.

Use of such a unit facilitates the maintenance, economically ensuring excellent printing properties and cleanability over a long period of time.

BEST MODE FOR CARRYING OUT THE INVENTION

Embodiments 1 to 4 of the present invention will specifically be described with proper reference to the drawings.

The first embodiment is characterized by a photosensitive layer in an OPC photosensitive drum, the second embodiment is characterized by a toner which is a developer, the third embodiment is characterized by a carrier, and the fourth embodiment is characterized by a cleaning blade.

[First Embodiment]

The first embodiment is an image formation method using electrophotography, in which a developing device is used to supply a developer onto a rotating photosensitive drum to form a toner image thereon, the formed toner image being transferred onto a transfer paper so that an image is formed on the transfer paper, the remaining developer being removed by use of a cleaning blade.

Then, in the image formation method using the electrophotography; use is made of the OPC photosensitive drum having a conductive base on which is formed a photosensitive layer with an initial thickness ranging from 20 to 50 μm (exclusive of 20 μm), and the amount X of reduction in the thickness of the photosensitive layer in the OPC photosensitive drum satisfies the following expression (1).

$$0.5\ \mu m < 30X/R < 1.5\ \mu m \quad (1)$$

X: By way of example, the amount (μm) of reduction in the thickness of the photosensitive layer when 10,000 sheets have been printed at a printing speed of 6 sheets per minute using an A4 size transfer paper longitudinal feeding device.

R: Diameter (mm) of the OPC photosensitive drum.

Figure 1:
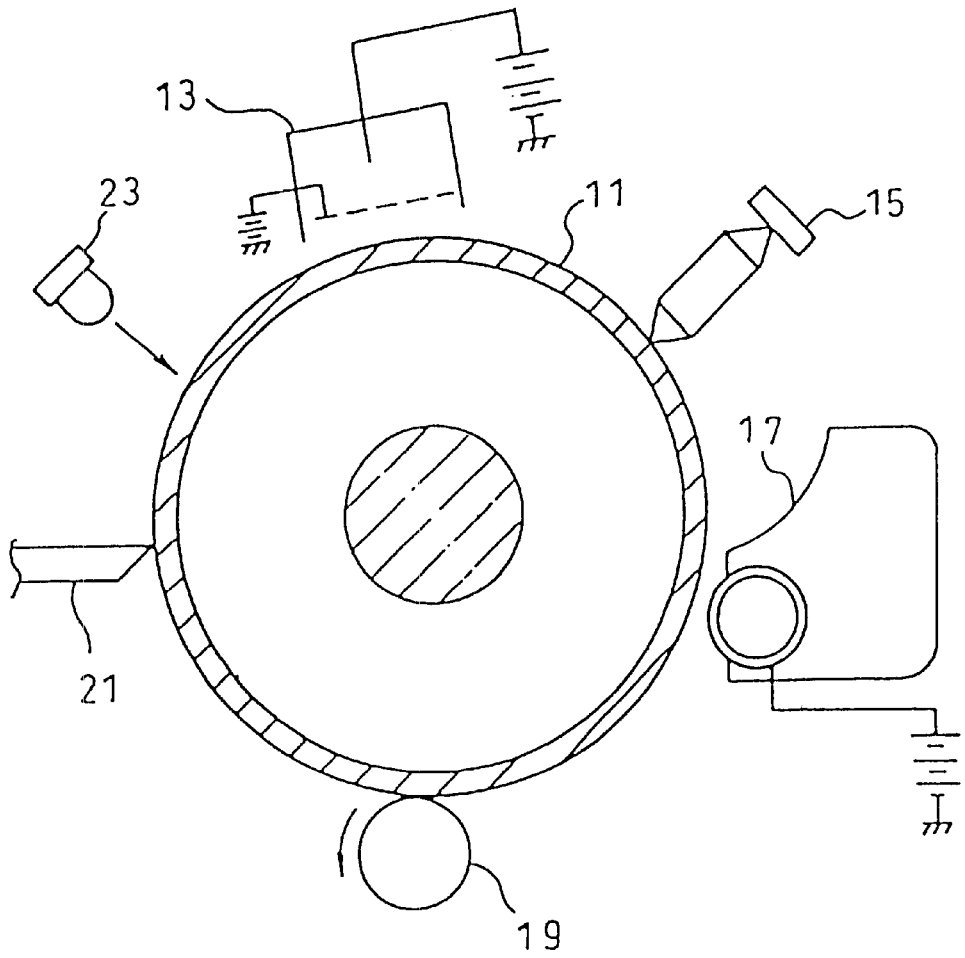
FIG. 1 is a diagram showing an example of a printing apparatus using electrophotography.

Incidentally, in the following description, the OPC photosensitive drum which characterizes the first embodiment is principally described. Therefore, the description of a charging device, the developing device, a transferring device, a fixing device, etc., in a printer for use in the first embodiment will be omitted for convenience sake, although they are not intended to be specifically limited. That is, use could be made of generally known ones in public use, for example, of the printer as shown in FIG. 1 and of the photosensitive drum shown in FIGS. 2 and 3. This applies to the second to fourth embodiments which will be described later.

(1) Thickness of Photosensitive Layer

First, the OPC photosensitive drum in the first embodiment includes a photosensitive layer formed on the conductive base, the photosensitive layer having an initial thickness ranging from 20 to 50 μm (exclusive of 20 μm). Accordingly, unlike the conventional OPC photosensitive drum, the OPC photosensitive drum in the first embodiment is characterized by use of the photosensitive layer having a relatively greater thickness.

It is to be noted that in case the photosensitive layer consists of a charge generation layer and a charge transfer layer in the first embodiment, the initial thickness of the photosensitive layer refers to a total value of the thickness of the respective layers.

Here, description is made of the reason to restrict the thickness of the photosensitive layer in this manner. That is, it is because if the initial thickness of the photosensitive layer becomes 20 μm or less, the time for holes generated in the charge generation layer in the photosensitive layer to move to the surface of the photosensitive layer becomes shortened, making it substantially difficult to regulate the potential at the photosensitive body. Therefore, so-called black points and blushing are prone to occur. Furthermore, if the thickness of the photosensitive layer results in 20 μm or less, it may become difficult to control the amount X of reduction in the thickness of the photosensitive layer to a predetermined range at 10,000 sheets corresponding time. It becomes therefore impossible to securely obtain excellent printing properties and cleanability at the 100,000 sheets corresponding time.

On the contrary, if the initial thickness of the photosensitive layer exceeds 50 μm, the photosensitive layer is apt to wear unevenly, making it substantially difficult to control the amount X of reduction in the thickness of the photosensitive layer to a predetermined range at the 10,000 corresponding time. Furthermore, if the initial thickness of the photosensitive layer exceeds 50 μm, the time taken for holes generated in the charge generation layer in the photosensitive layer to move to the surface of the photosensitive layer becomes elongated, making it substantially difficult to regulate the potential at the photosensitive body. Accordingly, problems such as the occurrence of so-called blushing and the tendency of the image density toward reduction are prone to take place.

Therefore, from the viewpoint of the regulation of the potential at the photosensitive body and of ensuring an improved balance between long-term printing properties and cleanability, etc., the initial thickness of the photosensitive layer in the OPC photosensitive drum is preferably a value within the range of 30 to 45 μm (exclusive of 30 μm) and more preferably a value within the range of 30 to 35 μm (exclusive of 30 μm).

Figure 4:
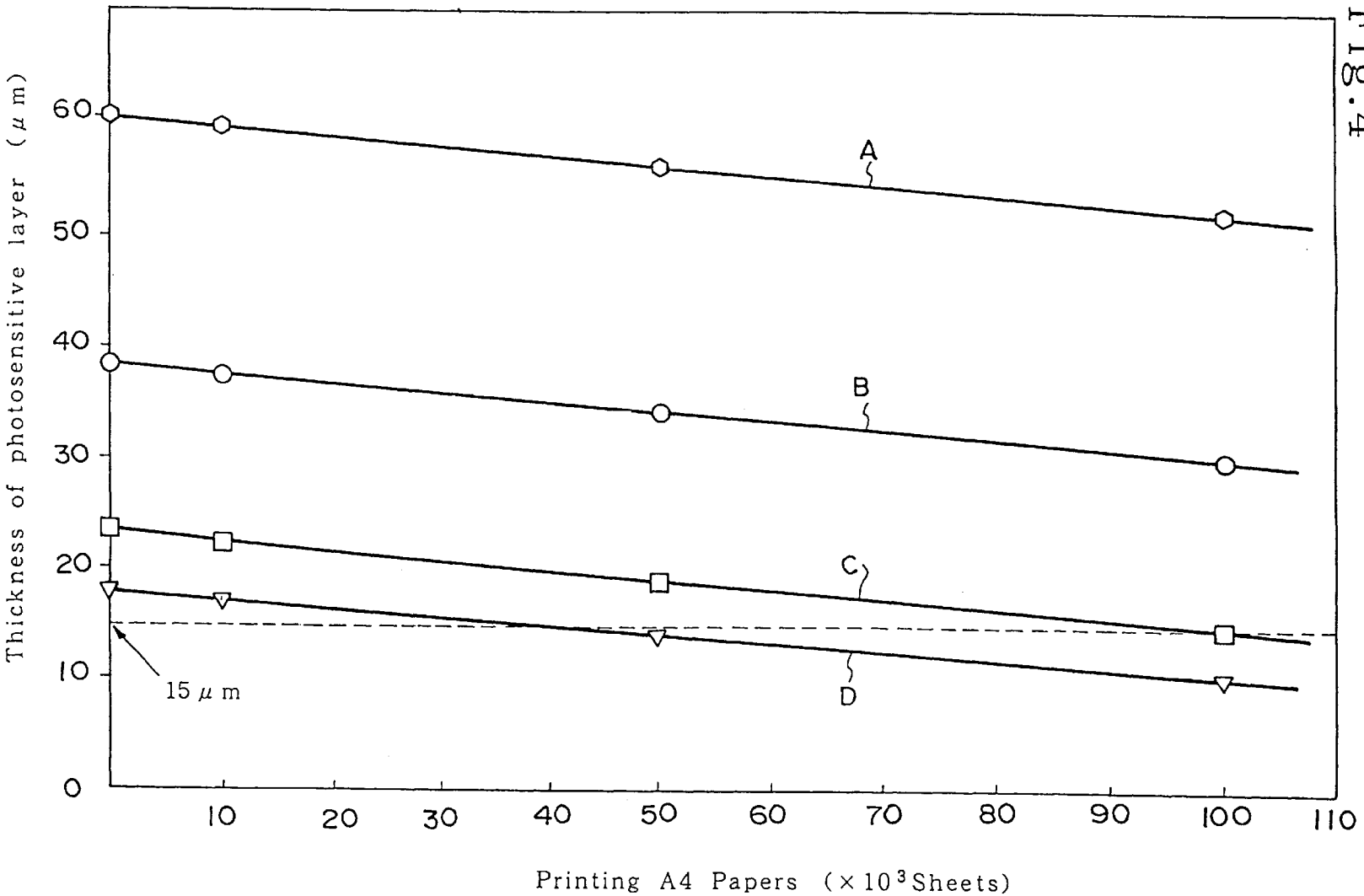
FIG. 4 is a diagram showing a relationship between the number of sheets of print of transfer paper and the thickness.

Referring to FIG. 4, the reason to limit the initial thickness of the photosensitive layer to the predetermined range will be described in greater detail. Besides, used as photosensitive drums were four types of photosensitive bodies (manufactured by Dainippon Ink and Chemicals, Inc.) which differ from one another only in the initial thickness of the photosensitive layer and which each include hydrazone-based material as the photosensitive material and polycarbonate type resin as a binder resin. That is, use was made of photosensitive drums the initial thickness of the photosensitive layer of which is 18 μm, 23 μm, 38 μm and 60 μm, respectively.

Then, in FIG. 4, the axis of abscissas represents the number of sheets of print of A4 size transfer paper in the case of use of the A4 size transfer paper longitudinal feeding apparatus, while the axis of ordinates represents the variation (μm) in thickness including the initial thickness of the photosensitive layer. In FIG. 4, a line A is a variation curve of the 60 μm photosensitive drum, a line B is a variation curve of the 38 μm photosensitive drum, a line C is a variation curve of the 23 μm photosensitive drum, and a line D is a variation curve of the 18 μm photosensitive drum.

As can easily be understood from the variation curves shown in FIG. 4, if the initial thickness is 20 μm or over, it is seen that a value of the order of 15 μm is securely obtained even at 100,000 sheets corresponding time. Then, generally if the photosensitive layer has a thickness of 15 μm or over, a proper hole mobility is obtained. That is, if the thickness is 20 μm or over, there can be obtained improved printing properties (image quality) without causing any blushing and black points even after the long-term use.

On the other hand, in the case of the photosensitive drum the thickness of which exceeds 50 μm (line A), the thickness remains above 50 μm even at 100,000 sheets corresponding time. Accordingly, as described hereinabove, when the initial thickness of the photosensitive layer exceeds 50 μm, the time taken for the holes generated in the charge generation layer in the photosensitive layer to move to the surface of the photosensitive layer is elongated, with the result that the problems such as the occurrence of the blushing and the tendency of the image density toward reduction are prone to take place.

Thus, also from each variation curve shown in FIG. 4, it is seen that it is preferable that the initial thickness of the photosensitive layer is a value within the range of 20 to 50 μm (exclusive of 20 μm).

Although not shown in FIG. 4, it is separately confirmed that the same tendency is obtained also in the case where the diameter of the OPC photosensitive drum is other than 30 mm.

As to the thickness of the photosensitive layer of the OPC photosensitive drum, the initial thickness from the apex of the highest protuberance lying on the surface of the conductive base to the surface of the photosensitive layer is preferably 10 μm or over.

It has proven that unevenness exists generally on the surface of the conductive base. Accordingly, in the area such as protuberances on the conductive base, where the photosensitive layer has a smaller initial thickness, the charge retaining function may lower, so that the black points or other image defects are apt to occur. Thus, by controlling the initial thickness from the apex of the highest protuberance lying on the surface of the conductive base to the surface of the photosensitive layer in this manner, it is possible to securely obtain excellent printing properties and cleanability over a long period of time.

More preferably, the initial thickness from the apex of the highest protuberance lying on the surface of the conductive base to the surface of the photosensitive layer is a value within the range of 15 to 40 μm, and most preferably a value within the range of 20 to 30 μm.

(2) Amount of Reduction in the Thickness

In the OPC photosensitive drum of the first embodiment, the amount X of reduction in the thickness at 10,000 sheets corresponding time must satisfy the above expression (1). Incidentally, the expression (1) is an expression allowing for the diameter (R) of the OPC photosensitive drum, and when the diameter is 30 mm for example, the coefficient (30/R) of the amount X of reduction in the thickness results in 1. In order to simplify the content, the following description is made on the case where the OPC photosensitive drum has a diameter of 30 mm.

First, the reason to set the amount X of reduction of the thickness to over 0.5 μm is that with the value of 0.5 μm or less the photosensitive layer becomes too hard to obtain a superior cleanability over a long period of time, with the result that so-called filming is prone to occur.

On the contrary, the reason to set the amount X of reduction of the thickness to under 1.5 μm is that the photosensitive layer becomes too soft and tends to wear unevenly, so that after the long-term use, for example, at 100,000 sheets corresponding time, no excellent printing properties are obtained allowing deficiencies such as filming to occur.

Accordingly, from the viewpoint achieving an improved balance between the cleanability and the printing properties at 100,000 sheets corresponding time, it is more preferred that the amount X of reduction in the thickness at 10000 sheets corresponding time is set to a value within 0.6 to 1.2 μm.

Figure 5:
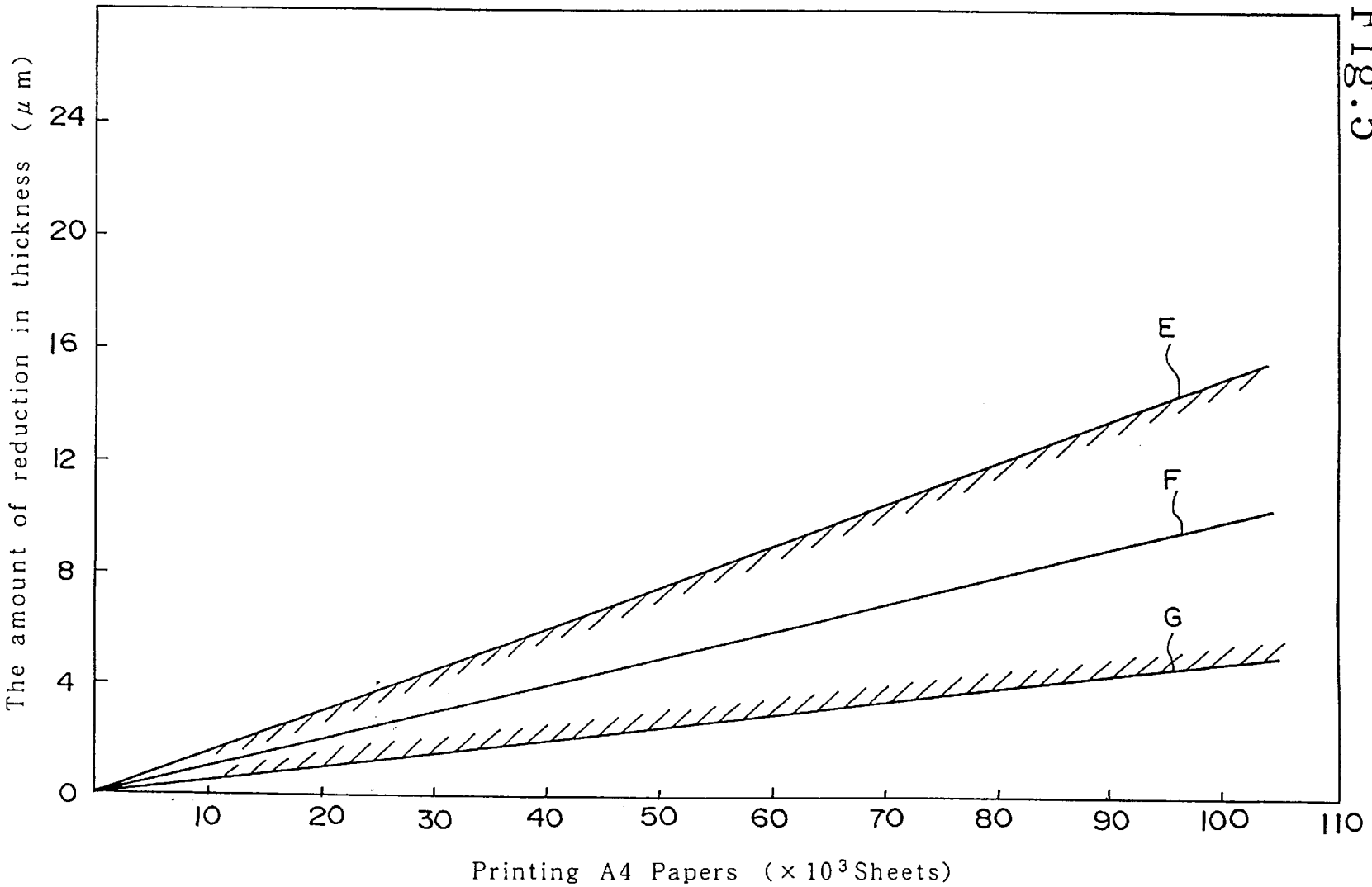
FIG. 5 is a diagram showing a relationship between the number of sheets of print of transfer paper and the amount of reduction in the thickness.

In this respect, reference is made to FIG. 5 to describe in detail the reason to control to a value within a predetermined range the amount X of reduction in the thickness at 10000 sheets corresponding time with the A4 size transfer paper longitudinal feeding apparatus. Besides, use was made of the photosensitive drum having the above photosensitive layer with the initial thickness of 38 μm.

First, in FIG. 5, the axis of abscissas represents the number of sheets of print of A4 size transfer paper in the case of using the A4 size transfer paper longitudinal feeding apparatus, while the axis of ordinates represents the amount X (μm) of reduction in the thickness of the photosensitive layer. A line E indicates an upper limit of the amount of reduction in the thickness, and a line G indicates a lower limit of the amount of reduction in the thickness. Furthermore, a line F is a curve indicative of a variation in the amount of reduction in the thickness of the above photosensitive drum.

As can easily be understood from FIG. 5, it is seen that the number of sheets of print of the A4 transfer paper is in proportion to the amount X of reduction in the thickness. That is, accordingly as the number of sheets of print of the A4 transfer paper increases, the value of the amount X of reduction in the thickness becomes large.

On the other hand, a tendency is found that at the time when the number of sheets of print of the A4 transfer paper has reached 10000 (10000 sheets corresponding time), the value of the amount X of reduction in the thickness results in a value of the order of 1 μm, exceeding the measurement error±0.5 μm).

Therefore, by controlling the amount X of reduction of the thickness to a predetermined range at 10000 sheets corresponding time, it is possible to accurately estimate the value of the amount X of reduction of the thickness at 100,000 sheets corresponding time.

Even though the value has deviated at 10,000 sheets corresponding time, it is easy to control the amount of reduction of the thickness to correct it to a proper range through the change of the thickness or material of the cleaning blade or through the change of the position of the cleaning blade.

Thus, by controlling the amount X of reduction of the thickness of the photosensitive layer in this manner, it is also possible to easily control the thickness of the photosensitive layer at 100,000 sheets corresponding time for example. Therefore, even after the long-term use, excellent printing properties and cleanability dan be obtained.

Although not shown in FIG. 5, it is separately confirmed that. the same tendency is obtained also in the case of the OPC photosensitive drum with a diameter other than 30 mm.

(3) Method for Measuring Amount of Reduction in Thickness

The method for measuring the amount X of reduction in the thickness in the expression (1) is not intended to be limitative in particular, although measurement could be made by way of example using a thickness measurement apparatus MCDP-2000 (manufactured by Otsuka Electronics Co., Ltd.) utilizing a nondestructive spectrointerference method.

It is also preferred that the measurement of the amount X of reduction in the thickness is carried out continuously or intermittently.

By measuring the amount X of reduction in the thickness in this manner, it is possible to easily and accurately control the value of the amount X of reduction in the thickness. Therefore, excellent printing properties and cleanability can securely be obtained. It is to be appreciated that FIGS. 4 and 5 illustrate the case in which the measurement of the amount X of reduction in the thickness has been carried out in an intermittent manner.

For carrying out the image formation method of the present invention, it is preferred to use as the amount X of reduction in the thickness a mean value of the amount of reduction in the thickness measured at three or more points on the OPC photosensitive drum in the direction of width thereof.

By measuring the amount X of reduction in the thickness in this manner, it is possible to more easily and accurately control the value of the amount X of reduction in the thickness while taking the dispersion in the measurement values into consideration. Therefore, excellent printing properties and cleanability can securely be obtained in the OPC photosensitive drum. It is to be appreciated that FIGS. 4 and 5 illustrate the case where the measurement of the amount X of reduction in the thickness has been performed at three points (right, center and left) on the drum in the direction of width thereof, with each drawing showing the mean values as the measurement data.

For carrying out the image formation method of the present invention, it is preferred by way of example that the rate of variation given as (Z–Y)/10,000 is a value within a range of 0.0005 to 0.0015 $\mu$m/sheet where Y is the amount ($\mu$m) of reduction in the thickness of the photosensitive layer when 10,000 sheets have been printed at a printing speed of 6 sheets/min. using the A4 size transfer paper longitudinal feeding apparatus, with Z being the amount ($\mu$m) of reduction in the thickness of the photosensitive layer when 20,000 sheets have been printed at the printing speed of 6 sheets/min. using the A4 size transfer paper longitudinal feeding apparatus.

By measuring the amount of reduction in the thickness in a certain period of time in this manner, it is possible to more easily and accurately control the value of the amount X of reduction in the thickness taking into consideration the rate of variation (tendency of variation) of the amount X of reduction in the thickness., Therefore, excellent printing properties and cleanability can more securely be obtained. This will easily be understood from the inclination of the graph of FIG. 4 as well.

(4) Binder Resin of Photosensitive Layer

In the photosensitive layer provided in the OPC photosensitive drum of the first embodiment, it is preferred to use as the binder resin polycarbonate (PC) resin, polyvinyl butyral (PVB) resin, polyvinyl formal (PVH) resin, polyacetal (PAc) resin, etc.

Use of these resins makes it easy to dissolve (disperse) phthalocyanine pigment or squalillium pigment which is a charge transfer material (CTM) to thereby control the charge (hole) mobility.

Among these resins, it is particularly preferred to use polycarbonate type resin.

The reason is that polycarbonate type resin is able to widely dissolve a variety of charge transfer materials, for example it is also capable of uniformly dissolving charge transfer materials having a rapid responsibility such as hydrazone compound, amine compound, etc. Thus, by using the polycarbonate type resin as the binder resin, it becomes possible to easily control the charge (hole) mobility in such a manner as to allow a rapid response, so that the occurrence of so-called blushing can be suppressed or the image density can easily be maintained within a certain range.

In addition, polycarbonate type resin has an appropriate hardness, heat resistance, durability, etc., ensuring a long-term acquisition of excellent printing properties and cleanability.

Although the type of the polycarbonate type resin is not. limitative in particular, it can be for example phenylpolycarbonate type resin (PHPC), biphenylpolycarbonate type resin (BPPC), tetraphenylpolycarbonate type resin (TPPC), and polycarbonate type resin (PCZ) having a cyclohexyl ring.

Figure 2:
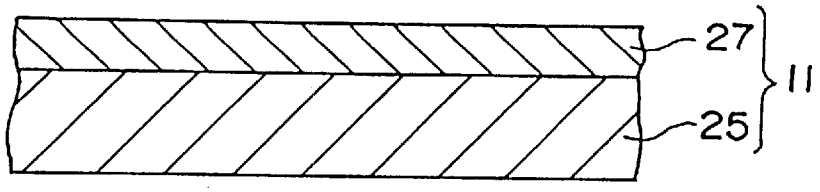
FIG. 2 is a diagram showing an example of an OPC photosensitive drum.
Figure 3:
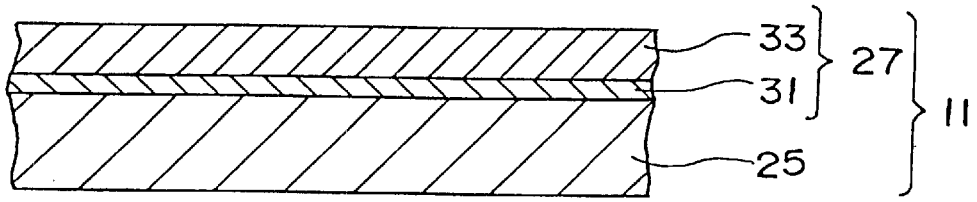
FIG. 3 is a diagram showing an example of the OPC photosensitive drum.

Typically, the photosensitive layer is in the form of a single layer as shown in FIG. 2 or in the form of plural layers consisting of a charge generation layer (CGL) formed on a conductive base (aluminum, etc.) and a charge transfer layer (CTL) formed thereon as shown in FIG. 3. It is to be appreciated that an undercoating layer (intermediate layer) may be provided between the conductive base and the charge generation layer (CGL) or between the charge generation layer and the charge transfer layer. It is therefore sufficient to use polycarbonate type resin or the above binder resin as at least the charge transfer layer. It is more preferable to use it also as the charge generation layer and further as the undercoating layer (intermediate layer).

(5) Hole Mobility in Photosensitive Layer

It is preferred that the hole mobility in the photosensitive layer (charge transfer layer) of the OPC photosensitive drum is a value not less than $1\times10^{-7}$ $cm^2/V\cdot S$.

By controlling the hole mobility in the charge transfer layer of the photosensitive layer in this manner, excellent printing properties (image quality) can be obtained even at 100,000 sheets corresponding time. That is, a so-called image blur is effectively prevented, achieving a satisfactory image contrast (black/white) and an appropriate image density value.

It is to be appreciated that the hole mobility in the photosensitive layer (charge transfer layer) can be figured out from a surface potential variation curve (light attenuation curve) obtained by irradiating a light with an irradiation wavelength ($\lambda$)=780 nm where a bias voltage is applied to the OPC photosensitive drum so that the electric field strength (E)=$2\times10^5$ (v/cm) is achieved under the environmental condition of 23° C. and 60% RH.

Therefore, from the viewpoint of acquisition of excellent printing properties (image quality) and halftone reproducibility, the hole mobility in the photosensitive layer (charge transfer layer) is preferably a value within the range of $5\times10^{-6}$ to $1\times10^{-3}$ $cm^2/V\cdot s$ under the condition where the electric field strength is $2\times10^5$ V/cm, and more preferably a value within the range of $8\times10^{-6}$ to $5\times10^{-4}$ $cm^2/V\cdot s$.

It is to be appreciated that the hole mobility in the photosensitive layer (charge transfer layer) can easily be controlled by the thickness of the photosensitive layer, the type of the binder resin, the type of the charge transfer material, loadings, the presence or absence of the undercoating layer (intermediate layer).

[Second Embodiment]

The second embodiment is an image formation method using electrophotography, in which a developing device is used to supply a developer onto a rotating photosensitive drum to form a toner image thereon, the formed toner image being transferred onto a transfer paper so that an image is formed on the transfer paper, the remaining developer being removed by use of a cleaning blade. It is characterized in that the toner as the developer contains coagulated abrasive particles.

By allowing the toner to contain the coagulated abrasive particles in this manner, the dispersibility of the toner is. improved enabling the toner to easily adhere to the OPC photosensitive drum in the process of development.

By virtue of the presence of the coagulated abrasive particles on the toner surface, the toner can easily be removed by use of the cleaning blade, and if an excess force has been applied thereto, the coagulated abrasive particles readily get loose, reducing a possibility of damage of the OPC photosensitive drum.

Furthermore, use of such coagulated abrasive particles into the toner enables so-called toner filming to effectively be prevented. It is therefore possible to suppress the occurrence of noise and to secure excellent printing properties and cleanability over a long period of time.

Incidentally, in the description of the second embodiment, the characteristic toner is principally described. Accordingly, the description of the OPC photosensitive drum, etc., which has already been made in the first embodiment, will be omitted hereat.

(1) Type of Toner

First, the type (including the form) of the toner is not particularly limitative in the second embodiment, and the toner can be one containing various pigments loaded into the binder resin such as styrene resin, acrylic resin, styrene-acrylic resin, polyester resin, epoxy resin, etc. The various pigments can include C. I. Pigment Blue 15 as a cyan pigment, C. I. Pigment Red 57:1 as a magenta pigment, and C. I. Pigment Yellow 12 as a yellow pigment.

It is also preferred to load a charge control agent (CCA) and a magnetic powder into the toner. The loading of such a charge control agent (CCA) and a magnetic powder facilitates the design of charge of the toner. Such a charge control agent (CCA) includes quaternary ammonium salt, organophosphorus compound, phosphoric compound, salicylic metal salt and tetraphenylborate. In order not to excessively abrade the photosensitive drum as a result of exposure onto the toner surface, the amount of the magnetic powder is preferably a value within the range of 1 to 25 parts by weight where the total amount of the toner is 100 parts by weight, and more preferably a value within the range of 2 to 20 parts by weight.

(2) Type of Coagulated Abrasive Particles

Description will then be made of the type of the coagulated abrasive particles in the second embodiment. The type of such coagulated abrasive particles is not particularly limitative, and it can be silica, electrically conductive titan, aluminum oxide, titanium oxide, silicon oxide, etc. These coagulated abrasive particles may be used solely or in combination of two or more types.

More preferred coagulated abrasive particles are silica and electrically conductive titan or either of the two. These coagulated abrasive particles have proper hardness and cohesiveness so as to allow the toner to more securely adhere to the OPC photosensitive drum in the process of development. Use of such coagulated abrasive particles enables unnecessary toner to easily be removed without damaging the OPC photosensitive drum, facilitating the design of transfer.

For carrying out the image formation method of the second embodiment, a primary particle diameter in the coagulated abrasive particles is preferably a value within the range of 0.01 to 0.1 $\mu$m, and a secondary particle diameter in the coagulated abrasive particles is preferably a value within the range of 0.2 to 1.0 $\mu$m.

By limiting the relationship between the primary particle diameter and the secondary particle diameter in the coagulated abrasive particles in this manner, it is possible for the coagulated abrasive particles to acquire appropriate hardness and cohesiveness (loosening properties). Thus, because of having a certain range of size, the coagulated abrasive particles provide an appropriate abrasive action on the OPC photosensitive drum, and becomes loose readily when subjected to an excessive force, tending to less damage the OPC photosensitive drum. In other words, the coagulated abrasive particles allow the toner to more securely adhere to the OPC photosensitive drum in the process of development, and enable the unnecessary toner to easily be removed without damaging the OPC photosensitive drum by use of the cleaning blade.

More preferably, therefore, the primary particle diameter in the coagulated abrasive particles is a value within the range of 0.02 to 0.08 $\mu$m, and the secondary particle diameter in the coagulated abrasive particles is a value within the range of 0.2 to 0.8 $\mu$m.

(3) Loadings of Coagulated Abrasive Particles

The loadings of the coagulated abrasive particles are not particularly limitative, although it is preferred that 0.1 to 10 parts by weight of the coagulated abrasive particles are contained in 100 parts by weight of the toner.

By setting the loadings of the coagulated abrasive particles to a value within such a range, the toner is allowed to securely adhere to the OPC photosensitive drum in the process of development. Furthermore, by use of the cleaning blade, the unnecessary toner can easily be removed without damaging the OPC photosensitive drum.

Accordingly, from the viewpoint achieving a superior balance between the adhesiveness of the toner onto the OPC photosensitive drum and the easiness of removal therefrom, 100 parts by weight of the toner preferably contains 0.5 to 8 parts by weight of the coagulated abrasive particles, and more preferably contains 1.0 to 5 parts by weight of the coagulated abrasive particles.

[Third Embodiment]

The third embodiment is characterized in that a two-component developer containing a carrier coated with a high molecular weight material and toner is used as the developer in the first embodiment.

In the case of using the two-component developer in this manner, the toner is supplied to a latent image for development while bringing a flexible magnetic brush into sliding contact with the OPC photosensitive drum. It is therefore possible to perform a uniform abrasion of the photosensitive body simultaneously with the development, assuring excellent printing properties and cleanability over a long period of time.

In the case of the non-magnetic one-component development method standing in contrast to the two-component developer, a rubber-made developing roller comes into direct contact with the photosensitive drum, with a difference in speed between the developing roller and the OPC photosensitive body to obtain a certain image density, so that a sharing force tends to occur allowing the OPC photosensitive drum to be subjected to a friction with the rubber roller.

Furthermore, in the case of the jumping development method standing in contrast to the two-component developer, use is made of magnetic toner containing a volume of (typically, 35 to 50% by weight) magnetic powder, so that the magnetic powder tends to be exposed on the toner surface. Accordingly, the thus exposed magnetic powder is prone to abrade the photosensitive layer in the OPC photosensitive drum.

Also, in the third embodiment, use is made of a carrier coated with a high molecular weight material, lessening a possibility that the carrier may damage the OPC photosensitive drum. It is therefore possible to easily and accurately control the value of the amount X of reduction in the thickness at 10,000 sheets corresponding time, thus ensuring excellent printing properties and cleanability over a long period of time.

It is to be noted that description of the third embodiment is principally made on the characteristic carrier. Therefore, the description of the OPC photosensitive drum, the toner, etc., which has already been made in the first and second embodiments, will be omitted hereat.

(1) Type of Carrier

In the third embodiment, the type of the carrier is not particularly limitative but it can be an inorganic oxide such as silica, titania, alumina, zinc oxide, tin oxide and iron oxide, or an organic compound in the form of e.g., polymer fine particles. These may be used solely or in combination of two or more types.

(2) Carrier Coated by High-molecular Weight Material

The third embodiment is characterized in that a high molecular weight material is coated on the surface of the carrier. Use of such a carrier coated with polyolefin type resin reduces a tendency for the carrier to damage the OPC photosensitive drum.

Such a high molecular weight material includes fluororesin, silicone resin, acrylic resin and polyethylene resin. Among them, it is preferred to use polyolefin type resin. The polyolefin type resin is advantageous in electrical insulating properties and contributes to the formation of a carrier having superior charging properties.

It is also preferred that the high molecular weight material coated on the surface of the carrier is formed of directly polymerized monomers.

By coating the carrier surface with the high molecular weight material obtained as a result of the direct polymerization of the monomers in this manner, it is possible to uniformly coat the high molecular weight material on the carrier surface in a close adhesive manner. Accordingly, the carrier tends to less damage the OPC photosensitive drum. Furthermore, improved adhesion between the high molecular weight material and the carrier reduces the tendency for the high molecular weight material to peel off.

In order to further improve the adhesion of the high molecular weight material coated on the carrier surface, it is preferred to perform either a thermal treatment or a mechanical treatment after the coating of the high molecular weight material on the surface of the carrier. Such a further improvement in the adhesion of the high molecular weight material ensures a long-term acquisition of excellent printing properties and cleanability.

For the thermal treatment, it is preferred to heat up to the melting point of the high molecular weight material or its glass transition temperature or over, and more specifically, it is preferred to heat up to the temperature range of 50 to 150° C. For the mechanical treatment, it is preferred to perform a treatment striking the high molecular weight material lying on the surface by means of a stirring machine such as Henschel mixer.

(3) Carrier Loadings

Preferably, the toner loadings are a value within the range of 1 to 25 parts by weight where the total amount of the developer is 100 parts by weight.

The carrier loadings less than 1 part by weight tend to reduce the amount of development, which may prevent an acquisition of excellent printing properties. On the contrary, the carrier loadings over 25 parts by weight tend to make it substantially difficult to control the charging characteristics of the toner.

Therefore, where the total amount of the developer is 100 parts by weight, the carrier loadings are preferably a value within the range of 2 to 20 parts by weight, and more preferably a value within the range of 3 to 15 parts by weight.

[Fourth Embodiment]

The fourth embodiment is characterized in that urethane type rubber is used as the cleaning blade in the first embodiment.

(1) Material and Thickness

In the fourth embodiment, it is preferred to use as the cleaning blade a urethane type rubber having a thickness within the range of 1.5 to 2.0 mm.

Use of the urethane type rubber is advantageous in that it has excellent durability and creep resistance. From the type of the raw material, the urethan type rubber is divided into two, that is, polyetherpolyurethane and polyesterpolyurethane, although it is preferred to use polyetherpolyurethane from the viewpoint of its superior resistance to hydrolysis.

Urethane type rubber having a thickness within such a range is able to apply an appropriate contact pressure onto the OPC photosensitive drum. Accordingly, by making up the cleaning blade in this manner, an excessive abrasion of the OPC photosensitive drum attributable to the cleaning blade becomes suppressed.

(2) Variable Mechanism

It is preferred to provide a variable mechanism for varying the position of the cleaning blade so as to correspond to the amount X of reduction in the thickness.

By allowing the position of the cleaning blade to be variable in this manner, the cleaning blade can be disposed at a position relatively away from the OPC photosensitive drum when the amount X of reduction in the thickness is small. On the contrary, when the amount X of reduction in the thickness is large, the cleaning blade can be disposed at a position relatively close to the OPC photosensitive drum. It is thus possible to apply a certain appropriate contact pressure to the OPC photosensitive drum, ensuring excellent printing properties and cleanability over a long-period of time.

It is to be noted that the variable mechanism is not particularly limitative and that the cleaning blade may be arranged on a movable rail or on a movable arm.

(3) Unit

For carrying out the image formation method of the fourth embodiment, it is preferred to use a unit consisting at least of the photosensitive drum, developing device and cleaning blade which have been integrated into one piece.

Use of such a unit facilitates the maintenance, enabling excellent printing properties and cleanability to be acquired at low costs over a long period of time.

EXAMPLES

The present invention will now be described in greater detail on the basis of examples thereof. It is to be noted that in the following description "parts" and "%" are expressed by weight unless specifically referred to.

Examples 1 to 3 and Comparison Examples 1 and 2

A printer FS-400 conversion type (6 sheets/min) manufactured by Kyocera Corporation and employing two-component development system was prepared. The printer was provided with a contact charging roller, a transfer roller, an urethane-made cleaning blade (1.8 mm, 2.0 mm, 2.2 mm in thickness), as well as an OPC photosensitive drum having the following specifications (photosensitive body: manufactured by Dainippon Ink and Chemicals, Inc.; includes hydrazone-based material as photosensitive material and polycarbonate type resin as binder resin; hereinafter all OPC photosensitive drums manufactured by Dainippon Ink and Chemicals, Inc.)

The contact pressure of the cleaning blade was varied and set to stages 1 to 5. That is, the stage 1 provides the weakest contact pressure (comparative example 1), the stages 2 to 4 provide a moderate contact pressure (examples 1 to 3), and the stage 5 provides the strongest contact pressure (comparative example 2).

With the thickness of the cleaning blade fixed at 2.0 mm, the contact pressures of the cleaning blade in the stages 1 and 5 were changed by moving the cleaning blade from the position in the stages 2 to 4 toward the photosensitive drum (stage 5) or farther away therefrom (stage 1). The contact pressures of the cleaning blade in the stages 2 to 4 were changed by setting the thickness of the cleaning blade to 1.8 mm (stage 2, Example 1), 2.0 mm (stage 3, Example 2) and 2.2 mm (stage 4, Example 3), respectively.

The thickness of the photosensitive layer in the OPC photosensitive drum was measured by use of thickness measurement apparatus MCDP-2000 (manufactured by Otsuka Electronics Co., Ltd.) employing nondestructive spectrointerference method.

It is to be noted that the thickness of the photosensitive layer was obtained by trisecting the OPC photosensitive drum in its width direction and measuring the thickness in the vicinity of the respective centers to figure out a mean value.

The hole mobility in the photosensitive layer (charge transfer layer) was figured out from a surface potential variation curve (light attenuation curve) obtained by irradiating a light with an irradiation wavelength ($\lambda$)=780 nm where a bias voltage is applied to the OPC photosensitive drum so that the electric field strength (E)=$2\times10^5$ (v/cm) is achieved under the environmental condition of 23° C. and 60% RH. In this respect, the same applies to the following examples, etc.

Furthermore, the surface protuberances on the substrate (aluminum) was measured by use of a contact finger type surface roughness meter (based on JIS B0561-1976).

(Specifications of OPC Photosensitive Drum)

Drum diameter: 30 mm

Hole mobility: $5\times10^{-6}$ $cm^2/V\cdot s$

Initial thickness: 35 $\mu$m

Surface protuberances on substrate: 1 $\mu$m or less

Then, using the printer FS-400 conversion type, the transfer of 100,000 sheets of A4 transfer paper was performed to evaluate (1) printing properties (image quality) and (2) cleanability on the basis of the following criteria. The amount of reduction in the film was measured at 10,000 sheets corresponding time. The obtained results are shown in Table 1.

(1) Evaluation of Printing Properties (Image Quality)

○(good): Image is clear using ISO5% printing pattern.

Δ(fair): Image is somewhat unclear using ISO5% printing pattern.

X(bad): Image is evidently unclear using ISO5% printing pattern.

(2) Cleanability

○(good): Cleanability is good, and no filming or blushing occurs.

Δ(fair): Cleanability is somewhat poor, and slight filming or blushing occurs.

X(bad): Cleanability is poor, and significant filming or blushing occurs.

TABLE 1

| | COMPARATIVE EXAMPLE 1 | EXAMPLE 1 | EXAMPLE 2 | EXAMPLE 3 | COMPARATIVE EXAMPLE 2 |
|---|---|---|---|---|---|
| INITIAL THICKNESS ($\mu$m) | 35 | 35 | 35 | 35 | 35 |
| AMOUNT OF REDUCTION IN THICKNESS ($\mu$m) | 0.3 | 0.7 | 1.0 | 1.3 | 2.0 |
| PRINTING PROPERTIES (INITIAL) | ○ | ○ | ○ | ○ | ○ |
| PRINTING PROPERTIES (100,000 SHEETS) | × | ○ | ○ | ○ | × |
| CLEANABILITY (100,000 SHEETS) | × (FILMING) | ○ | ○ | ○ | Δ (BLUSHING) |

As can be seen from the results shown in Table 1, it was confirmed that the OPC photosensitive drum the amount of reduction in the film of which is within the range of 0.5 to 1.5 $\mu$m at 10,000 sheets corresponding time (examples 1 to 3) provided excellent printing properties (image quality) and cleanability (anti-filming properties) even at 100,000 sheets corresponding time.

On the other hand, it was confirmed that the OPC photosensitive drum the amount of reduction in the film of which is less than 0.5 $\mu$m or more than 1.5 $\mu$m at 10,000 sheets corresponding time provided poor printing properties (image quality) and cleanability (anti-filming properties) at 100,000 sheets corresponding time.

Comparison Examples 3 to 7

In the same manner as the example 1, the printer FS-400 conversion type (6 sheets/min) manufactured by Kyocera Corporation and employing the two-component development system was prepared. The printer was provided with the contact charging roller, the transfer roller, the urethane-made cleaning blade (2.0 mm thick), as well as the OPC photosensitive drum having the following specifications. It is to be noted that the initial thickness of the OPC photosensitive drum was set to 15 $\mu$m, a fairly small value.

Also, in the same manner as the example 1, the contact pressure of the cleaning blade was varied and set to stages 1 to 5. That is, the stage 1 provides the weakest contact pressure (comparative example 3), with the comparative examples 4 to 6 having respective contact pressures increasing in the mentioned order, and the stage 5 provides the strongest contact pressure (comparative example 7).

(Specifications of OPC Photosensitive Drum)

Drum diameter: 30 mm
Hole mobility: $5\times10^{-6}$ $cm^2/V\cdot s$
Initial thickness: 15 $\mu m$
Surface protuberances on substrate: 1 $\mu m$ or less Then, in the same manner as the example 1, the printer FS-400 conversion type was used to perform the transfer to 100,000 sheets of A4 transfer paper, and evaluation was made of (1) printing properties (image quality) and (2) cleanability. The amount of reduction in the film was measured at 10,000 sheets corresponding time. The obtained results are shown in Table 2.

TABLE 2

| | COMPARATIVE EXAMPLE 3 | COMPARATIVE EXAMPLE 4 | COMPARATIVE EXAMPLE 5 | COMPARATIVE EXAMPLE 6 | COMPARATIVE EXAMPLE 7 |
|---|---|---|---|---|---|
| INITIAL THICKNESS ($\mu m$) | 15 | 15 | 15 | 15 | 15 |
| AMOUNT OF REDUCTION IN THICKNESS ($\mu m$) | 0.3 | 0.7 | 1.0 | 1.3 | 2.0 |
| PRINTING PROPERTIES (INITIAL) | ○ | ○ | ○ | ○ | ○ |
| PRINTING PROPERTIES (100,000 SHEETS) | × | × | × | × | × |
| CLEANABILITY (100,000 SHEETS) | × (FILMING) | ○ | ○ | ○ | Δ (BLUSHING) |

As can be seen from the results shown in Table 2, it was confirmed that not only the OPC photosensitive drum the amount of reduction in the film of which is less than 1.5 $\mu m$ or more than 1.5 $\mu m$ (comparative examples 3 and 7) at 10,000 sheets corresponding time but also the OPC photosensitive drum the amount of reduction In the film is within the range of 0.5 to 1.5 $\mu m$ (comparative examples 4 to 6) provided poor printing properties (image quality) and cleanability at 100,000 sheets corresponding time.

It Is therefore understood that the initial thickness must be over a certain value (more than 20 $\mu m$) in order to obtain excellent printing properties (image quality) and cleanability.

Comparison Examples 8 to 12

In the same manner as the example 1, the printer FS-400 conversion type (6 sheets/min) manufactured by Kyocera Corporation and employing the two-component development system was prepared. The printer was provided with the contact charging roller, the transfer roller, the urethane-made cleaning blade (2.0 mm thick), as well as the OPC photosensitive drum having the following specifications. It is to be noted that the initial thickness of the OPC photosensitive drum was set to 55 $\mu m$, a fairly large value.

Also , in the same manner as the example 1, the contact pressure of the cleaning blade was varied and set to stages 1 to 5. That is, the stage 1 provides the weakest contact pressure (comparative example 8), with the comparative examples 9 to 11 having respective contact pressures increasing in the mentioned order, and the stage 5 provides the strongest contact pressure (comparative example 12).

(Specifications of OPC Photosensitive Drum)

Drum diameter: 30 mm
Hole mobility: $5\times10^{-6}$ $cm^2/V\cdot s$
Initial thickness: 55 $\mu m$
Surface protuberances on substrate: 1 $\mu m$ or less Then, in the same manner as the example 1, the printer FS-400 conversion type was used to perform the transfer to 100,000 sheets of A4 transfer paper, and evaluation was made of (1) printing properties (image quality) and (2) cleanability. The amount of reduction in the film was measured at 10,000 sheets corresponding time. The obtained results are shown in Table 3.

TABLE 3

| | COMPARATIVE EXAMPLE 8 | COMPARATIVE EXAMPLE 9 | COMPARATIVE EXAMPLE 10 | COMPARATIVE EXAMPLE 11 | COMPARATIVE EXAMPLE 12 |
|---|---|---|---|---|---|
| INITIAL THICKNESS ($\mu m$) | 55 | 55 | 55 | 55 | 55 |
| AMOUNT OF REDUCTION IN THICKNESS ($\mu m$) | 0.3 | 0.7 | 1.0 | 1.3 | 2.0 |
| PRINTING PROPERTIES (INITIAL) | × | × | × | × | × |
| PRINTING PROPERTIES (100,000 SHEETS) | × | ○ | ○ | ○ | Δ |

TABLE 3-continued

| | COMPARATIVE EXAMPLE 8 | COMPARATIVE EXAMPLE 9 | COMPARATIVE EXAMPLE 10 | COMPARATIVE EXAMPLE 11 | COMPARATIVE EXAMPLE 12 |
|---|---|---|---|---|---|
| CLEANABILITY (100,000 SHEETS) | × (FILMING) | ○ | ○ | ○ | Δ (BLUSHING) |

As can be seen from the results shown in Table 3, it was confirmed that not only the OPC photosensitive drum the amount of reduction in the film of which is less than 1.5 μm or more than 1.5 μm (comparative examples 3 and 7) at 10,000 sheets corresponding time but also OPC photosensitive drum the amount of reduction in the film is within the range of 0.5 to 1.5 μm (comparative examples 4 to 6) provided poor printing properties (image quality) and cleanability at 100,000 sheets corresponding time.

It is therefore understood that the initial thickness must be a certain value or less (50 μm or less) in order to obtain excellent printing properties (image quality) and cleanability.

Examples 4 to 9

Consideration was made of the influence of the height of the surface protuberances on the substrate. That is, in the same manner as the example 1, the printer FS-400 conversion type (6 sheets/min) manufactured by Kyocera Corporation and employing the two-component development system was prepared. The printer was provided with the contact charging roller, the transfer roller, the urethane-made cleaning blade (2.0 mm thick), as well as the OPC photosensitive drum having the following specifications.

It is to be noted that the initial thickness of the OPC photosensitive drum was set to 15 μm, with the height of the surface protuberances on the substrate being intentionally set to 5 μm and 12 μm. The height of the surface protuberances is defined as a difference between the maximum value and the minimum value on the substrate and is measured by the surface roughness meter for instance.

Also, in the same manner as the examples 1 to 3, the contact pressure of the cleaning blade was varied and set to 2 to 4 stages.

(Specifications of OPC Photosensitive Drum)

Drum diameter: 30 mm

Hole mobility: $5\times10^{-6}$ $cm^2/V\cdot s$

Initial thickness: 30 μm

Surface protuberances on substrate: 5 μm, 12 μm Then, in the same manner as the example 1, the printer FS-400 conversion type was used to perform the transfer to 100,000 sheets of A4 transfer paper, and evaluation was made of (1) printing properties (image quality) and (2) cleanability. Furthermore, the amount of reduction in the film was measured at 10,000 sheets corresponding time.

As a result, the examples 4 to 8 showed the amount of reduction in the film within the range of 0.7 to 1.3 μm at 10,000 sheets corresponding time, posing no problems on the printing properties (image quality) and cleanability even at 100,000 sheets corresponding time.

On the contrary, in the example (example 9) where the contact pressure of the cleaning blade was set to four stages with the surface protuberances on the substrate being 12 μm, there was found a tendency for black points (0.2 mm or more in diameter) to occur in the printing properties (image quality) although the cleanability had no problems. Furthermore, when the thickness from the highest protuberance to the photosensitive layer surface was measured in the example 9, about 8 μm was obtained. It was therefore confirmed that the thickness of the photosensitive layer had become unevenly abraded.

Examples 10 to 24 and Comparison Examples 13 to 17

Consideration was made of the influence of the hole mobility in the photosensitive layer (charge transfer layer). That is, in the same manner as the example 1, the printer FS-400 conversion type (6 sheets/min) manufactured by Kyocera Corporation and employing the two-component development system was prepared. The printer was provided with the contact charging roller, the transfer roller, the urethane-made cleaning blade (2.0 mm thick), as well as the OPC photosensitive drum having the following specifications.

(Specifications of OPC Photosensitive Drum)

Drum diameter: 30 mm

Hole mobility: $5\times10^{-7}$, $8\times10^{-7}$, $2\times10^{-6}$ $cm^2/V\cdot s$ Initial thickness: 20, 35, 50, 60 μm Surface protuberances on substrate: 1 μm or less Then, under the environment of the temperature of 10° C. and the humidity of 20%RH which are conditions causing the hole mobility to lower, the transfer to 100,000 sheets of A4 transfer paper was carried out to evaluate (1) printing properties (image quality) and (2) cleanability in the same manner as the example 1. The obtained results are shown in Table 4.

Incidentally, the evaluation in this embodiment, etc., is performed in the form of acceleration test. That is, it has separately been proven that the same tendency is obtained in the ordinary room temperature conditions (temperature of 25° C.; humidity of 50%RH) as well if excellent printing properties (image quality) and cleanability are obtained under such an environment of the temperature of 10° C. and the humidity of 20%RH.

As can been seen from the results, although the cause is supposed to lie in too a large initial thickness of 60 μm of the photosensitive layer, the comparative examples 13 to 17 presented phenomena such as blurring of the image, with poor printing properties (image quality) at 100,000 sheets corresponding time. It is to be noted that the printing properties were initially poor and that such a tendency was remarkable in the comparative examples 13 to 16 in particular.

On the contrary, the examples 10 to 13, 16 to 19 and 24 achieved excellent printing properties even at 100,000 sheets corresponding time.

The example 14 had a tendency that the halftone reproducibility was somewhat poor at 100,000 sheets corresponding time.

Furthermore, the examples 15 and 20 to 23 tended to be somewhat-poor in contrast at 100,000 sheets corresponding time, but with a sufficient image density.

TABLE 4

| | PHOTOSENSITIVE LAYER THICKNESS (μm) | HOLE MOBILITY ($Cm^2/V \cdot S$) | PRINTING PROPERTIES |
|---|---|---|---|
| EXAMPLE 10 | 20 | $5 \times 10^{-7}$ | ○ |
| EXAMPLE 11 | 20 | $2 \times 10^{-6}$ | ○ |
| EXAMPLE 12 | 20 | $8 \times 10^{-6}$ | ○ |
| EXAMPLE 13 | 20 | $5 \times 10^{-4}$ | ○ |
| EXAMPLE 14 | 20 | $1 \times 10^{-3}$ | Δ |
| EXAMPLE 15 | 35 | $5 \times 10^{-7}$ | ○ |
| EXAMPLE 16 | 35 | $2 \times 10^{-6}$ | ○ |
| EXAMPLE 17 | 35 | $8 \times 10^{-6}$ | ○ |
| EXAMPLE 18 | 35 | $5 \times 10^{-4}$ | ○ |
| EXAMPLE 19 | 50 | $1 \times 10^{-3}$ | ○ |
| EXAMPLE 20 | 50 | $5 \times 10^{-7}$ | Δ |
| EXAMPLE 21 | 50 | $2 \times 10^{-6}$ | ○ |
| EXAMPLE 22 | 50 | $8 \times 10^{-6}$ | ○ |
| EXAMPLE 23 | 50 | $5 \times 10^{-4}$ | ○ |
| EXAMPLE 24 | 50 | $1 \times 10^{-3}$ | ○ |
| COMPARATIVE EXAMPLE 13 | 60 | $5 \times 10^{-7}$ | × |
| COMPARATIVE EXAMPLE 14 | 60 | $2 \times 10^{-6}$ | × |
| COMPARATIVE EXAMPLE 15 | 60 | $8 \times 10^{-6}$ | × |
| COMPARATIVE EXAMPLE 16 | 60 | $5 \times 10^{-4}$ | Δ |
| COMPARATIVE EXAMPLE 17 | 60 | $1 \times 10^{-3}$ | Δ |

Examples 25, 26 and Comparison Examples 18, 19

Consideration was made of the effect of coating of the carrier surface with a high molecular weight material. That is, in the same manner as the example 1, the printer FS-400 conversion type (6 sheets/min) manufactured by Kyocera Corporation and employing the two-component development system was prepared. The printer was provided with the contact charging roller, the transfer roller, the urethane-made cleaning blade (2.0 mm thick), as well as the OPC photosensitive drum having the following specifications.

Then, a carrier (example 25) having a surface coated with polyethylene resin and a carrier (example 26) having an uncoated surface were prepared and combined separately with toner (5% by weight) so that their respective carrier weight occupied 95% by weight, to obtain a developer. Besides, the toner also contained 5 parts by weight of magnetic material per 100 parts by weight.

At the same time, comparatives were respectively made between these examples 16 and 17, nonmagnetic one-component phenomena (comparative example 18) and magnetic jumping phenomena (comparative example 19).

(Specifications of OPC Photosensitive Drum)

Drum diameter: 30 mm

Hole mobility: $5 \times 10^{-6}$ $cm^2/V \cdot s$

Initial thickness: 35 μm

Surface protuberances on substrate: 1 μm or less

Then, in the same manner as the example 1, the printer FS-400 conversion type was used to perform a continuous transfer to A4 transfer paper, and evaluation was made of the printing properties and cleanability. Furthermore, the number of sheets at which image defects occurred (the number of sheets of print when the image quality remarkably lowered) and the presence or absence of black points generated (0.2 mm or more in diameter) were visually measured. The obtained results are shown in Table 5.

As can be seen from the results shown in Table 5, even in the case of use of the carrier (example 26) with the uncoated surface, lowering in the image quality was not found until 100,000 sheets corresponding time, although significant lowering in the image quality was observed after the elapse of 150,000 sheets corresponding time.

On the other hand, in the case of use of the carrier (example 27) having the surface coated with polyethylene resin, no lowering in the image quality was found even after the elapse of 150,000 sheets corresponding time. It was therefore confirmed that use of the carrier having the surface coated with a high molecular weight material (polyethylene resin) contributed to a remarkable improvement in the printing properties.

In the case of nonmagnetic one-component phenomena (comparative example 18), the amount of reduction in the film at 10,000 sheets corresponding time was as extremely large as 5.45 μm, so that remarkable lowering in the image quality was observed before the elapse of 100,000 sheets corresponding time, more specifically, at 23,000 sheets.

Furthermore, in the case of the magnetic jumping phenomena (comparative example 19) as well, the amount of reduction in the film at 10,000 sheets corresponding time was as extremely large as 7.0 μm, so that remarkable lowering in the image quality was observed at 30,000 sheets.

TABLE 5

| | EXAMPLE 25 | EXAMPLE 26 | COMPARATIVE EXAMPLE 18 | COMPARATIVE EXAMPLE 19 |
|---|---|---|---|---|
| DEVELOPMENT SYSTEM | TWO-COMPONENT | TWO-COMPONENT | NONMAGNETIC ONE-COMPONENT | MAGNETIC JUMPING |
| CARRIER | PE COATING | NO PE COATING | — | — |
| AMOUNT OF REDUCTION IN THICKNESS (μm) | 0.86 | 1.7 | 5.5 | 7.0 |
| PRINTING PROPERTIES (INITIAL) | ○ | ○ | ○ | ○ |
| PRINTING PROPERTIES (100,000 | ○ | ○ | × | × |

TABLE 5-continued

| | EXAMPLE 25 | EXAMPLE 26 | COMPARATIVE EXAMPLE 18 | COMPARATIVE EXAMPLE 19 |
|---|---|---|---|---|
| SHEETS) CLEANABILITY (100,000 SHEETS) | ○ | ○ | × | × |
| BLACK POINTS GENERATED (100,000 SHEETS) | ABSENT | SLIGHTLY PRESENT | PRESENT | PRESENT |
| NUMBER OF IMAGE DEFECTIVE SHEETS GENERATED | 150,000 SHEETS OR MORE | 100,000 SHEETS OR MORE | 23,000 SHEETS | 30,000 SHEETS |

Examples 27 to 32

Consideration was made of the effect of loading of the coagulated abrasive particles into the toner. That is, in the same manner as the example 1, the printer FS-400 conversion type (6 sheets/min) manufactured by Kyocera Corporation and employing the two-component development system was prepared. The printer was provided with the contact charging roller, the transfer roller, the urethane-made cleaning blade (2.0 mm thick), as well as the OPC photosensitive drum having the following specifications.

(Specifications of OPC Photosensitive Drum)

Drum diameter: 30 mm

Hole mobility: $5\times10^{-6}$ $cm^2/V\cdot s$

Initial thickness: 35 $\mu$m

Surface protuberances on substrate: 1 $\mu$m or less

Then, toner loaded with coagulated abrasive particles (examples 28 to 32) and toner loaded with uncoagulated abrasive particles (example 27) were prepared and combined separately with the toner (5% by weight) so that the carrier weight occupied 95% by weight, to obtain a developer.

Below are details of the composition of the toner loaded with the coagulated abrasive particles. For making such a toner, a biaxial extruder was used to melt and mix polyester resin, charging control agent S-34 (produced by Orient Corporation), polypropylene wax and carbon black. The mixture was cooled down to room temperature and subjected to coarse grinding, medium grinding and fine grinding by use of a jet mill, and then classified to obtain spherical bodies with an average particle diameter of 7 $\mu$m.

Into the thus obtained spherical bodies were loaded hydrophobic silica as a fluidizing agent in 0.5% by weight and electrically conductive titania (0.05 $\mu$m in primary particle diameter) as an abrasive agent in 1.0% by weight, which were mixed by the Henschel mixer while varying the mixing time and the number of revolutions to make a toner.

The resultant toner was observed by means of an SEM (electron microscope), so that it had proven that the electrically conductive titania lied in the form of aggregate within the range of 0.1 to 1.15 $\mu$m on the surfaces (examples 28 to 32).

The composite of the uncoagulated abrasive particle loaded toner on the other hand being the same as that of the coagulated abrasive particle loaded toner, an ordinary propeller mixer was used to make a toner instead of the Henschel mixer. The resultant toner was observed using the SEM (electron microscope), so that it had proven that the electrically conductive titania lied on the surfaces in the form of separate pieces of 0.05 $\mu$m each without cohering (example 27).

(Toner Composition)

Polyester resin: 100 parts by weight

Charging control agent (S-34): 2 parts by weight

Polypropylene wax: 4 parts by weight

Carbon black: 5 parts by weight

Hydrophobic silica: 0.5 parts by weight (for spherical bodies)

Electrically conductive titania: 1.0 parts by weight (for spherical bodies)

Then, in the same manner as the example 1, the printer FS-400 conversion type was used to perform a continuous transfer to the A4 transfer paper, and measurement was made of the number of sheets at which image defects had occurred. The obtained results are shown in Table 6.

As can be seen from the results, in the example 27 (toner loaded with uncoagulated abrasive particles) and the example 28 (0.05 $\mu$m in coagulated abrasive particle diameter), remarkable lowering in the image quality was not found until 100,000 sheets corresponding time, although lowering in the image quality was observed after the elapse of 150,000 sheets corresponding time.

In the case of examples 29 to 31, remarkable lowering in the image quality was not found until 150,000 sheets corresponding time. It was therefore confirmed that by using the toner loaded with the coagulated abrasive particles each having a particle diameter not less than a predetermined value, the printing properties were drastically improved.

Furthermore, in the case of the example 32, remarkable lowering in the image quality was not found until 100,000 sheets corresponding time, although occurrence of black points (0.2 mm or more in diameter) was partly observed.

It was therefore confirmed that by using the abrasive particles each having a particle diameter within a certain range, the printing properties, etc., were significantly improved.

TABLE 6

| | EXAMPLE 27 | EXAMPLE 28 | EXAMPLE 29 | EXAMPLE 30 | EXAMPLE 31 | EXAMPLE 32 |
|---|---|---|---|---|---|---|
| COAGULATED PARTICLES (PRIMARY DIAMETER) | 0.05 | 0.05 | 0.05 | 0.05 | 0.05 | 0.05 |
| COAGULATED PARTICLES (SECONDARY DIAMETER) | 0.05 | 0.10 | 0.50 | 0.80 | 1.00 | 1.15 |
| AMOUNT OF REDUCTION IN THICKNESS ($\mu$m) | 0.5 | 0.6 | 0.6 | 0.6 | 0.7 | 1.0 |
| PRINTING PROPERTIES (INITIAL) | ○ | ○ | ○ | ○ | ○ | ○ |
| PRINTING PROPERTIES (100,000 SHEETS) | ○ | ○ | ○ | ○ | ○ | ○ |
| CLEANABILITY (100,000 SHEETS) | Δ~○ | ○ | ○ | ○ | ○ | |
| BLACK POINTS GENERATED (100,000 SHEETS) | ○ | ○ | ○ | ○ | ○ | SLIGHTLY PRESENT |
| NUMBER OF IMAGE DEFECTIVE SHEETS GENERATED | 100,000 OR MORE | 150,000 OR MORE | 150,000 OR MORE | 150,000 OR MORE | 100,000 OR MORE | 100,000 OR MORE |

Examples 33, 34

Consideration was made 6f the influence of the dimension of the diameter in the photosensitive layer. That is, in the same manner as the example 1, the printer FS-400 conversion type (6 sheets/min) manufactured by Kyocera Corporation and employing the two-component development system was prepared. The printer was provided with the contact charging roller, the transfer roller, the urethane-made cleaning blade (2.0 mm thick), as well as the OPC photosensitive drum having the following specifications.

(Specifications of OPC Photosensitive Drum)

Drum diameter: 20, 40 mm

Hole mobility: $5\times10^{-6}$ $cm^2/V\cdot s$

Initial thickness:

50 $\mu$m (drum diameter of 20 mm)

23 $\mu$m (drum diameter of 40 mm)

Surface protuberances on substrate: 1, $\mu$m or less

Then, in the same manner as the example 1, the printer FS-400 conversion type was used to perform the transfer to 100,000 sheets of A4 transfer paper, and evaluation was made of (1) printing properties (image quality) and (2) cleanability, so that it was confirmed that both the examples 33 and 34 achieved excellent printing properties (image quality) and cleanability.

In the examples 33 and 34, the amount X of reduction in the thickness was measured at 100,000 sheets corresponding time, so that it was confirmed that the expression (1) was satisfied. It was therefore proven that excellent printing properties (image quality) and cleanability were secured even after a long-term use irrespective of the drum diameter as long as the expression (1) was satisfied.

Industrial Applicability

According to the present invention, by setting the initial thickness of the photosensitive layer to a value within a predetermined range in a printing apparatus such as a printer and by setting the amount X of reduction in the thickness of the photosensitive layer at 100,000 sheets corresponding time to a value within a predetermined range, it has become possible to provide an image formation method using electrophotography, capable of achieving excellent printing properties and cleanability even at 100,000 sheets corresponding time.

Furthermore, by setting the hole mobility in the charge. transfer layer of the photosensitive layer to a value within a predetermined range, it has become possible to provide an image formation method using electrophotography, capable of obtaining superior printing properties.

Also, by using as a developer a two-component developer containing carrier and toner, and by coating the carrier surface with a high molecular weight material, it has become possible to provide an image formation method using electrophotography, capable of ensuring excellent printing properties and cleanability over a longer period of time.

Moreover, by causing the toner in the developer to contain coagulated abrasive particles, it has become possible to provide an image formation method using electrophotography, capable of ensuring excellent printing properties and cleanability over a longer period of time.

Additionally, by using urethane type rubber having a predetermined thickness for the cleaning blade, it has become possible to provide an image formation method using electrophotography, capable of ensuring excellent printing properties and cleanability over a longer period of time.

What is claimed is:

1. An apparatus for electro-photographic image formation and transfer of a toner image to a transfer medium, comprising:

a rotatable organic photoconductor photosensitive drum, on which an electrostatic latent image is formed, having a photosensitive layer and an electrically conductive base formed on an outer surface of the drum, the photoconductive layer having an initial thickness in a range of 20 to 50 μm;

a developing device arranged to supply a developer to a surface of the photosensitive layer to form a toner image corresponding to the electrostatic latent image, the developer comprising a carrier and a toner including coagulated abrasive particles; and a cleaning blade arranged to remove an untransferred developer from the surface of the photosensitive layer;

wherein the apparatus is arranged to reduce the thickness of the photosensitive layer by an amount X in accordance with the following expression (1)

$$0.5\ \mu m < 30X/R < 1.5\ \mu m \quad (1)$$

where X is the amount of a reduction in thickness of the photosensitive layer in μm occurring when 10,000 sheets of A4 size have been printed lengthwise, or an equivalent total length has been printed, and R is the absolute value of the diameter in mm of the drum.

2. The apparatus of claim 1, further comprising a measuring device arranged to measure a thickness of the photosensitive layer; and wherein position, thickness or material of the cleaning blade is adjusted responsive to the measured thickness to maintain X within the range of the expression (1).

3. The apparatus of claim 1 wherein the measuring device measures the amount of a reduction in thickness in a continuous or intermittent manner.

4. The apparatus of claim 1 wherein the position of the cleaning blade can be changed responsive to the measured reduction amount.

5. The apparatus of claim 1 wherein the amount X in thickness is a mean value of reductions in thickness measured at three or more points on the drum in the width direction thereof.

6. The apparatus of claim 1 wherein a rate of change expressed as (Z−Y)/10,000 is a value within the range of 0.00005 to 0.00015 μm/sheet where Y is the amount (μm) of a reduction in thickness of the photosensitive layer when 10,000 sheets of A4 size have been printed lengthwise, or an equivalent total length has been printed, Z is the amount (μm) of a reduction in thickness of the photosensitive layer when 20,000 sheets of A4 size have been printed lengthwise, or an equivalent total length has been printed.

7. The apparatus of claim 1 wherein a thickness from an apex of a highest protuberance lying on a surface of the electrical conductive base to the surface of the photosensitive layer is a value not less than 10 μm.

8. The apparatus of claim 1 wherein the photosensitive layer comprises a charge generation layer and a charge transfer layer formed thereon, and wherein the hole mobility in the charge transfer layer is a value not less than $1\times10^{-7}$ $cm^2/V\cdot s$ in the condition that the electric field strength is about $2\times10^5$ V/cm.

9. The apparatus of claim 1 wherein the photosensitive layer contains a polycarbonate resin.

10. The apparatus of claim 1 wherein the loading of the toner are a value within the range of 1 to 25 parts by weight when the total amount of the developer is 100 parts by weight.

11. The apparatus of claim 1 wherein an outer surface of the carrier is coated with a polyolefin resin.

12. The apparatus of claim 1 wherein the loadings of the coagulated abrasive particles are a value within the range of 0.1 to 10 parts by weight when the total amount of the toner is 100 parts by weight.

13. The apparatus of claim 1 wherein a primary particle diameter of the coagulated abrasive particles is a value within the range of 0.01 to 0.1 μm, and wherein a secondary particle diameter of the coagulated abrasive particles is a value within the range of 0.2 to 1.0 μm.

14. The apparatus of claim 1 wherein the coagulated abrasive particles are selected from silica or electrically conductive titania or a combination thereof.

15. The apparatus of claim 1 wherein the coagulated abrasive particles adhere to a surface of the toner.

16. The apparatus of claim 1 wherein the cleaning blade is formed from urethane rubber having a thickness within the range of 1.5 to 2.0 mm.

17. The apparatus of claim 1 wherein at least the drum, the developing device and the cleaning blade are integrated into a unit.

18. The apparatus of claim 1, wherein clean images can be produced when 100,000 sheets have been printed.

19. An apparatus for electro-photographic image formation and transfer of a toner image to a transfer medium, comprising:

a rotatable organic photoconductor photosensitive drum, on which an electrostatic latent image is formed, having a photosensitive layer and an electrically conductive base formed on an outer surface of the drum, the photoconductive layer having an initial thickness in a range of 20 to 50 μm;

a developing device arranged to supply a developer to a surface of the photosensitive layer to form a toner image corresponding to the electrostatic latent image; and a cleaning blade arranged to remove an untransferred developer from the surface of the photosensitive layer;

wherein the apparatus is arranged to reduce the thickness of the photosensitive layer by an amount X in accordance with the following expression (1)

$$0.5\ \mu m < 30X/R < 1.5\ \mu m \quad (1)$$

where X is the amount of a reduction in thickness of the photosensitive layer in μm occurring when 10,000 sheets of A4 size have been printed lengthwise, or an equivalent total length has been printed, and R is the absolute value of the diameter in mm of the drum.

20. A method for electro-photographic image formation, comprising:

forming an electrostatic latent image on a rotatable organic photoconductor photosensitive drum, the drum having a photosensitive layer and an electrically conductive base formed on an outer surface thereof, the photoconductive layer having an initial thickness in a range of 20 to 50 μm;

developing a toner image corresponding to the electrostatic latent image, by applying a developer to a surface of the photosensitive layer, the developer comprising a carrier and a toner including coagulated abrasive particles;

transferring the toner image to a transfer medium;

cleaning an untransferred developer from the surface of the photosensitive layer by a cleaning blade; and reducing the thickness of the photosensitive layer by an amount X in accordance with the following expression (1)

$$0.5\ \mu m < 30X/R < 1.5\ \mu m \quad (1)$$

where X is the amount of a reduction in thickness of the photosensitive layer in $\mu$m occurring when 10,000 sheets of A4 size have been printed lengthwise, or an equivalent total length has been printed, and R is the absolute value of the diameter in mm of the drum.

* * * * *